United States Patent [19]

Gomi et al.

[11] Patent Number: 4,752,202

[45] Date of Patent: Jun. 21, 1988

[54] APPARATUS FOR PRODUCING ORIENTED FIBER AGGREGATE

[75] Inventors: Fukuo Gomi, Nagoya; Tomohito Ito, Ohbu; Renichi Isomura, Kariya, all of Japan

[73] Assignee: Kabushiki Kaisha Toyoda Jidoshokki Seisakusho, Aichi, Japan

[21] Appl. No.: 3,032

[22] Filed: Jan. 13, 1987

[30] Foreign Application Priority Data

Jan. 17, 1986 [JP] Japan ..... 61-008440

[51] Int. Cl.[4] ..... B28B 17/00

[52] U.S. Cl. ..... 428/174.8 R; 425/174.8 E; 264/24; 264/108

[58] Field of Search ..... 425/174.8 R, 174 E, 425/84, 174.8 E; 264/24, 108; 162/108

[56] References Cited

U.S. PATENT DOCUMENTS

| | | | |
|---|---|---|---|
| 3,012,923 | 12/1961 | Slayter | 264/108 |
| 3,073,732 | 1/1963 | Hunsdiecker | 264/108 |
| 3,497,419 | 2/1970 | Winer et al. | 162/153 |
| 3,954,364 | 5/1976 | Talbott et al. | 425/174.8 E |
| 3,960,650 | 6/1976 | Parks et al. | 162/108 |
| 4,111,294 | 9/1978 | Carpenter et al. | 264/24 |
| 4,432,916 | 2/1984 | Logan | 425/174.8 E |

FOREIGN PATENT DOCUMENTS

| | | | |
|---|---|---|---|
| 1914316 | 10/1970 | Fed. Rep. of Germany | 264/24 |

*Primary Examiner*—Charles Hart

*Attorney, Agent, or Firm*—Berman, Aisenberg & Platt

[57] ABSTRACT

The present invention relates to an apparatus for continuously producing one-dimensionally oriented fiber aggregate in which an orientation vessel includes a case, a supply portion, an orientation portion, a discharge portion, at least one pair of electrodes disposed on the orientation portion of the vessel, and a sheet drive unit. A dielectric fluid in which whiskers and/or short fibers are dispersed is supplied downwardly, and the fibers oriented one-dimensionally by means of high voltage applied across electrodes disposed in an orientation vessel. The sheet drive unit moves a long filter sheet disposed horizontally between the orientation portion and the discharge portion of the orientation vessel to enable the dielectric liquid to pass the filter sheet to the discharge portion of the vessel, and permitting the fibers to aggregate on the sheet.

8 Claims, 3 Drawing Sheets

APPARATUS FOR PRODUCING ORIENTED FIBER AGGREGATE

BACKGROUND OF THE INVENTION

1. Field of the Invention

The present invention relates to an apparatus for producing fiber aggregate, and more particularly, it relates to an apparatus for continuously producing fiber aggregate in which most fibers are one-dimensionally oriented. "One-dimensional orientation" means that many fibers are oriented in about the same direction. This definition applies not only to the fiber aggregate but also to the orientation step to be mentioned later.

2. Discussion of the Background

Heretofore, fiber aggregate of short fibers or whiskers has been produced by using one of the conventional apparatuses mentioned below.

The first one is a centrifugal forming apparatus as shown in FIG. 4 (disclosed in Japanese Patent Laid-open No. 65200/1985). In operation of this apparatus, an aqueous suspension of silicon carbide whiskers or the like is fed through the supply pipe 24 to the porous cylindrical vessel 23 which is lined with the filter film 25 and disposed in the outer cylinder 21. The hollow fiber aggregate 26 is formed by centrifugal action. Water is discharged from the water outlet 22.

The second one is a suctional forming apparatus as shown in FIG. 5. In operation of this apparatus, a prescribed amount of fiber-containing fluid 34 is fed to the cylinder 31, and a pressure is applied to the fluid 34 by the pressing plunger 32 arranged above the cylinder 31. At the same time, the filtrate is removed by suction through the filter 33 disposed at the bottom of the cylinder 31. Thus the fibers in the fluid are oriented and aggregated.

The fiber aggregate formed by the above-said centrifugal forming apparatus or suctional forming apparatus is not composed of one-dimensionally oriented fibers, but is composed mainly of two- or three-dimensionally oriented fibers. The fiber aggregate with such orientation has a disadvantage that it does not provide a sufficient strength in the desired one-dimensional direction when incorporated into fiber-reinforced metal (referred to as FRM hereinafter). Additional disadvantages are the low volume ratio of fiber and the excessive spring back at the time of compression molding.

With the conventional apparatuses, it was impossible to produce one-dimensional oriented fiber aggregate and it was only possible to produce two- or three-dimensionally oriented fiber aggregate. It was also impossible to produce fiber aggregate continuously.

It is an object of the present invention to provide an apparatus for producing fiber aggregate in which most fibers are one-dimensionally oriented. The fiber aggregate produced by using the apparatus of this invention has a high fiber volume ratio and a low degree of spring back. When incorporated into FRM, it provides FRM having a high strength in the desired one dimension. With the apparatus of the present invention, it is possible to produce one-dimensionally oriented fiber aggregate continuously by using the sheet drive unit which moves the long filter sheet horizontally.

SUMMARY OF THE INVENTION

The apparatus of the present invention for producing oriented fiber aggregate comprises an orientation vessel, at least one pair of positive electrode and negative electrode, and a sheet drive unit. The orientation vessel includes a case, a supply part, an orientation part and a discharge part. The supply part is placed at the upper part of the vessel and it receives a dielectric liquid in which whiskers, short fibers or the like are dispersed, and supplies the dielectric liquid downward. The discharge part discharges the dielectric liquid downward. The dielectric liquid moves downward from the supply part to the discharge part through the orientation part. The electrodes are installed vertically at a certain distance apart horizontally in the orientation part of the orientation vessel. The sheet drive unit moves a long filter sheet horizontally between the orientation part and the discharge part in the orientation vessel. The filter sheet permitting the dielectric liquid to pass therethrough and permitting the fibers to aggregate thereon.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings wherein.

DETAILED DESCRIPTION OF THE INVENTION

Figure 1:
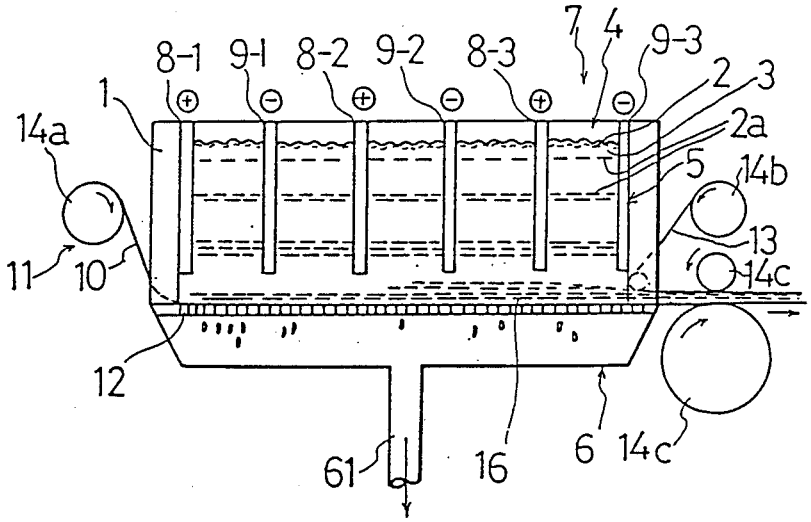
FIG. 1 is a schematic sectional view of the apparatus of the invention for producing oriented fiber aggregate.

As shown in FIG. 1, the orientation vessel includes a supply part 4 placed above which receives a dielectric liquid 3 in which are dispersed short fibers 2 or the like and supplies the dielectric liquid downward, a discharge part 6 which discharges the dielectric liquid downward, and an orientation part 5 through which the dielectric liquid moves downward from the supply part 4 to the discharge part 6.

The supply part 4 should have such a structure as to receive the dielectric liquid in which fibers are dispersed. An alternative structure may be possible in which there is disposed above the supply part 4 a dispersion unit to disperse fibers into the dielectric liquid or a supply unit (not shown) to supply the dielectric liquid.

In addition, the supply part may have a resistance flow regulator to reduce the flow rate of the dielectric liquid in which fibers are dispersed.

The resistance flow regulator is designed to reduce the flow rate of the incoming liquid and prevent the turbulence that would otherwise occur in random directions in the orientation vessel, whereby permitting the adequate dispersion of fibers.

The resistance flow regulator may have a horizontal baffle plate which shifts the flow of the fiber-dispersing dielectric liquid entering from above into the horizontal direction. The horizontal baffle plate may have a "V" shape or may be a horizontal plate. In addition, the horizontal baffle plate may have holes of desired shape.

Figure 2:
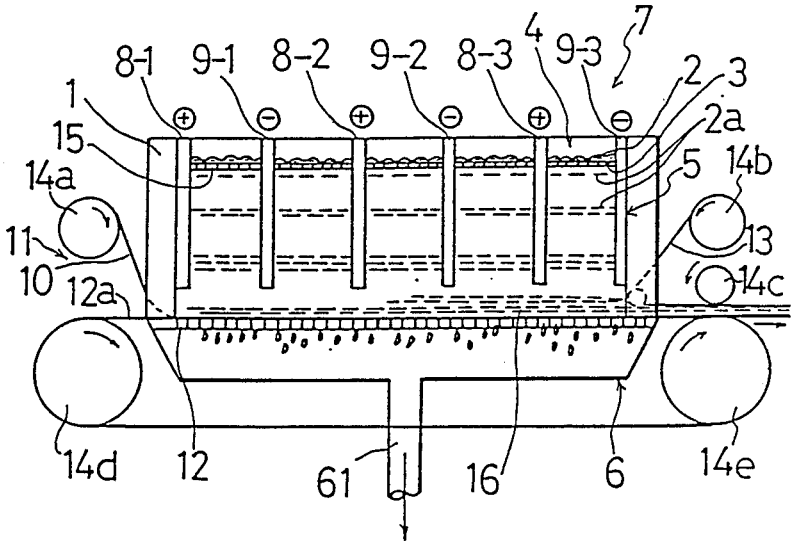
FIG. 2 is a schematic sectional view of the apparatus used in the example for producing oriented fiber aggregate.

The resistance flow regulator may be a suspending regulator 15 having a large number of through holes as shown in FIG. 2. The through holes may be arranged vertically or aslant to the left direction or to the left and right directions.

As shown in FIG. 1, the discharge part has usually a drain pipe 61 connected to the bottom of the orientation part. Incidentally, the supply part, orientation part, and discharge part are not specifically limited in shape and size, and they are properly selected according to the object and application.

The positive and negative electrodes are installed in the orientation part of the orientation vessel. They extend vertically and are spaced horizontally at certain intervals. There are at lest one pair of positive and negative electrodes. The positive and negative electrodes are usually of plate shape. Usually two or more pairs of positive and negative electrodes are installed alternatively at certain intervals as shown in FIG. 1. In this case it is possible to reduce the distance between the positive and negative electrodes in each orientation part. This is convenient because of the one-dimensional orientation can be carried out with a comparatively small electric field. The positive and negative electrodes can be made of a common material such as copper.

As shown in FIG. 1, the sheet drive unit 11 is installed between the orientation part 5 and the discharge part 6 in the orientation vessel 7. It horizontally drives the long filter sheet 10 which permits the dielectric liquid to pass therethrough and the fibers to aggregate thereon.

There is disposed the filter plate 12 or filter belt **12*a* at the upper end of the discharge part 6, as shown in FIG. 1 or 2. The filter plate 12 may be constructed such that the filter sheet 10** slidingly moves on it.

Figure 3:
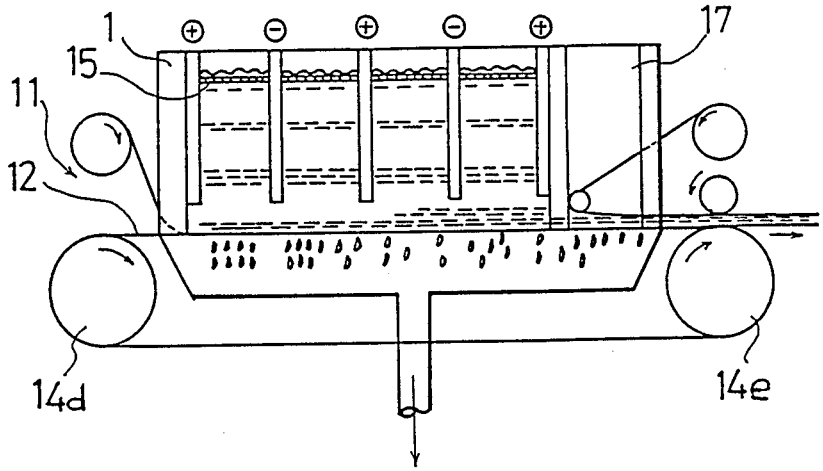
FIG. 3 is a schematic sectional view of another embodiment of the apparatus of the invention for producing oriented fiber aggregate.
Figure 4:
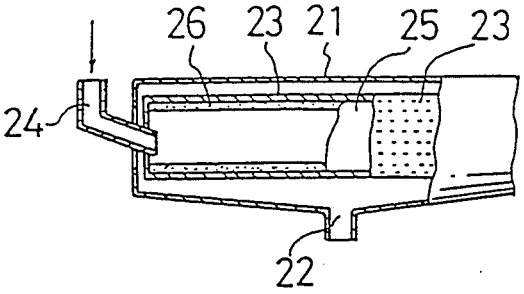
FIG.4 (PRIOR ART)
FIG. 4 is a partly cutaway sectional view of the conventional centrifugal forming apparatus.
Figure 5:
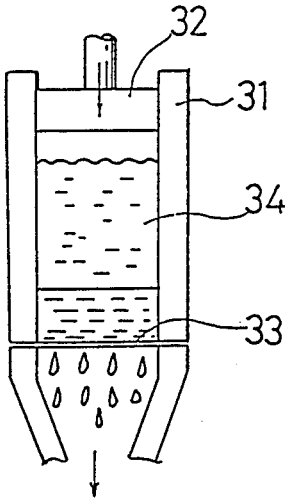
FIG.5 (PRIOR ART)
FIG. 5 is a schematic sectional view of the conventional suctional forming apparatus.

The sheet drive unit 11 may have, at the downstream side of the filter sheet 10, a cover part to supply a long covering sheet 13 which covers the fibers which have aggregated on the filter sheet 10, as shown in FIG. 1. The covering with the covering sheet 13 may be carried out at the place where the fiber aggregate 16 has emerged from the case 1 of the orientation vessel 7, as shown in FIG. 1, or at the entrance of the compression vessel 17 which arranged at the downstream side of the filter sheet in the case 1, as shown in FIG. 3. The latter case is preferable because it is possible to produce fiber aggregate having a greater compression ratio.

The apparatus of the invention may be provided with a high voltage source supply device (not shown) to generate an electric field between the positive electrode 8 and negative electrode 9 as shown in FIG. 1.

The apparatus of the invention as shown in FIG. 2 is operated in the following manner to produce the fiber aggregate in which most fibers are one-dimensionally oriented.

The first step of the process of the invention for producing fiber aggregate is the dispersion step in which short fibers, whiskers, or the like are dispersed into a dielectric liquid.

The fibers used in the dispersion step are short fibers or whiskers or a mixture thereof. Short fibers and whiskers of any kind can be used. They are not specifically limited in diameter and length. Also, they are not limited in material so long as they are capable of static orientation in the dielectric liquid when a high voltage is applied across the positive and negative electrodes. The material of the fiber includes, for example, alumina, silica, alumina-silica, beryllia, carbon, silicon carbide, glass, and metals. Either fibers of single material or a mixture of fibers of different materials may be used.

The dielectrical liquid means a liquid which exhibits the dielectric properties upon application of a high voltage. Examples of the dielectric liquid include carbon tetrachloride, fluorine-and chlorine-substituted hydrocarbon, n-hexane, and cyclohexane. Preferable among them is carbon tetrachloride. Fluorine- and chlorine - substituted hydrocarbons are preferable from the standpoint of handling safety.

Fibers of some kinds or state may need surface treatment to loosen fibers sticking together. To facilitate the dispersion of fibers, a proper amount of surface active agent, especially a nonionic surface active agent, should be added to the dielectric liquid.

The second step of the process of the invention is the orientation step, in which the dielectric liquid containing the fibers dispersed therein is placed in a space between a positive electrode and a negative electrode across which a high voltage is applied, so that individual fibers in the dielectric liquid are statically orientated, with one end pointing to the positive electrode and the other end pointing to the negative electrode. The state in which most fibers are oriented in one direction across the positive and negative electrodes is referred to as "one-dimensional orientation".

In the orientation step, usually an electric field of about 0.1 to 5 $kV/cm^2$ is generated between the positive and negative electrodes. An electric field weaker than 0.1 $kV/cm^2$ is not enough for the static orientation of fibers; and an electric field stronger than 5 $kV/cm^2$ disturbs the dielectric liquid and interferes with the orientation of fibers. Preferred electric field is about 1 to 2 $kV/cm^2$. It is suitable for static orientation of fibers with a minimum disturbance of the dielectric liquid. The intensity of electric field should be properly established according to the dielectric properties of the fibers and dielectric liquid to be used and the thickness of the fiber aggregate to be produced.

Furthermore, electric potential difference can be very small between the positive and negative electrodes when more than two pair of electrodes are used to shorten the distances between each pair of the electrodes in a each orientation vessel.

The individual fibers which have been statically oriented as mentioned above are mostly strung to one another in one direction (referred to as electrode direction hereinafter) perpendicular to the direction in which the fibers settle. The stringing fibers settle faster than discrete fibers.

In the third step, the statically oriented fibers are continuously aggregate on the filter sheet while the orientated state of the fibers are being maintained, and there is continuously obtained fiber aggregate in which may fibers are one-dimensionally oriented.

The aggregating step may be accomplished by filtering by suction the dielectric liquid containing fibers oriented in the orientation step, in the direction perpendicular to the orientation direction of the fiber, whereby the oriented fibers **2*a* are collected on the filter sheet 10. The dielectric liquid in the orientation vessel 7 is discharged and then the gate (not shown) of the case 1 is opened and the filter sheet 10 is continuously moved horizontally, whereby the fiber aggregate 16 is continuously taken off. In this case it is preferable to compress the fiber aggregate 16 with the compression roller 14*c***.

The fiber aggregate produced by the aggregating step may be in the form of comparatively thick mat shape or comparatively thin film shape.

The thus produced fiber aggregate in which many fibers are one-dimensionally oriented is used, as such or after cutting to a desired shape or placing one top of another, as the molded fiber reinforcement for FRM.

The apparatus of the invention for producing one-dimensionally oriented fiber aggregate comprises an orientation vessel including a supply part, orientation part, and discharge part; at least one pair of positive electrode and negative electrode; and a sheet drive unit moving a long fiber sheet horizontally between the orientation part and the discharge part in the orientation vessel, above-mentioned filter sheet permitting the dielectric liquid to pass therethrough and permitting the fibers to aggregate thereon.

The apparatus of the present invention makes it possible to aggregate fibers on the filter sheet in such a manner that many fibers are one-dimensionally oriented and causes the sheet drive unit to move the filter sheet horizontally. Thus it permits the continuous production of fiber aggregate in which many fibers are one-dimensionally oriented.

The apparatus of the present invention provides fiber aggregate in which many fibers are one-dimensionally oriented, so that the fiber aggregate has less entanglement of fibers and has a high fiber volume ratio. Therefore, the fiber aggregate provides FRM of high strength.

The apparatus of the present invention provides fiber aggregate having less entanglement of fibers. Therefore, it has a low degree of spring back, and it provides FRM of high precision.

DESCRIPTION OF THE PREFERRED EMBODIMENT

Having generally described this invention, a further understanding can be obtained by reference to certain specific examples which are provided herein for purposes of illustration only and are not intended to be limiting unless otherwise specified.

The invention is now described with reference to the following examples.

The apparatus used in this example is shown in FIG. 2. This apparatus is made up of the following components.

(1) The resistance flow regulator 15 (suspending flow regulator) to control the flow rate of the incoming fiber-dispersed dielectric fluid;

(2) The orientation vessel 7 which consists of the case 1 the supply part 4, the discharge part 6, and the orientation part 5. (The supply part 4 receives through the suspending flow regulator 15 the dielectric fluid 3 in which short fibers 2, etc., are dispersed, and supplies the dielectric liquid 3 downward. The discharge part 6 discharges the dielectric liquid 3 downward. The orientation part 5 permits the dielectric liquid 2 to move from the supply part 4 to the discharge part 6.);

(3) Three sets (or five pairs) of positive electrodes 8 and negative electrodes 9 installed alternately in the vertical direction at intervals in the horizontal direction in the orientation part 5 of the orientation vessel 7;

(4) The sheet drive unit 11 to move the long filter sheet 10 in the horizontal direction. The filter sheet 10 is placed between the orientation part 5 and the discharge part 6 in the orientation vessel 7. It permits the dielectric fluid 3 to pass therethrough and the fibers to aggregate thereon; and (5) The high voltage source apply device (not shown) to apply a high voltage across the electrodes 8 and 9.

The filter sheet 10 is disposed on the porous belt **12*a* such as cloth. The porous belt 12*a* and the filter sheet 10 are supported on the filter plate 12 disposed at the top of the discharge part 6. The porous belt 12*a* is driven by the drive pulley 14*e* and the idle pulley 14*d***.

The sheet drive unit 11 has at the downstream side of the filter sheet 10, the covering part to supply the long covering sheet 13 which covers the fibers which have aggregated on the filter sheet 10. The covering part comprises the covering sheet supply pulley **14*b* and the like. In addition, the sheet drive unit 11 has the compression rollers 14*c* and 14*e* to compress the fiber aggregate 16 covered with the covering sheet 13. There is the drain pipe 61 at the bottom of the case 1**, and it is sucked by a suction unit (not shown).

Carbon tetrachloride was placed in the space between the electrodes in the static orientation apparatus. An electric field of about 0.1 to 5 $kV/cm^2$ was generated. The dielectric liquid 3 into which the fibers 2 have been dispersed was poured into the supply part 4 through the suspending flow regulator 15.

Using this apparatus, fiber aggregate was produced in the following manner.

Aluminum short fibers without surface treatment (having an average diameter of about 3 $\mu m$ and a length of 10 to 500 $\mu m$) are added to carbon tetrachoride along with a small amount of nonionic surface active agent. The fibers are dispersed by stirring.

The fiber-dispersed dielectric liquid fed from the supply part 4 is continuously sent to the orientation part 5. Owing to the electric field generated between the positive electrode 8 and the negative electrode 9 in the orientation part 5, the fibers undergo static orientation, with one end of the fiber pointing to the positive electrode and the other end pointing to the negative electrode. The statically oriented fibers **2*a* become strung while they were settling, and the strung fibers settled in the state of one-dimensional orientation in the direction across the positive and negative electrodes. The dielectric liquid is sent further downward, and the dielectric liquid alone is passed through the filter sheet 10 and sent to the discharge part 6. The statically oriented fibers are aggregated on the filter sheet 10 in the one-dimensionally oriented state. In this way there was obtained fiber aggregate 16** in the mat type form.

Since suction is applied to the lower part of the porous belt 12 through the drain pipe 61, the dielectric liquid is discharged from the orientation vessel 7, and then the gate on the side wall of the orientation vessel 7 is opened to permit the movement of the filter sheet. Thus the fiber aggregate 16 is forced out by the filter belt **12*a*. The fiber aggregate 16 is subsequently covered with the covering sheet 13 and compressed by the compressing rollers 14*c* and 14*e***.

The above-mentioned apparatus is made up of the orientation vessel, three sets (five pairs) of positive and negative electrodes, and the sheet drive unit to move the long filter sheet in the horizontal direction, above-mentioned filter sheet being installed between the orientation part and the discharge part in the orientation vessel and permitting the dielectric liquid to pass therethrough and the fibers to aggregate thereon. Therefore, the apparatus continuously provides fiber aggregate in which many fibers are one-dimensionally oriented well.

In addition, the apparatus is provided with the covering part to cover the fiber aggregate with the covering sheet and the compressing rollers to compress the covered fiber aggregate. Therefore, it can produce continuously easy-to-wind fiber aggregate which is free of foreign matters and has a high fiber volume ratio.

The fiber aggregate in this example is one-dimensionally oriented, and consequently it has a higher fiber volume ratio and a lower degree of spring back than the conventional ones. Thus it provides FRM of high precision.

Having now fully described the invention, it will be apparent to one of ordinary skill in the art that many changes and modifications can be made thereto without departing from the spirit or scope of the invention as set forth herein.

What is claimed is:

1. An apparatus for producing oriented fiber aggregate which comprises:

an orientation vessel, at least one pair of electrodes comprising a positive electrode and a negative electrode, a filter sheet drive unit, and a cover part;

said orientation vessel including a case, a supply part for receiving a dielectric liquid in which are dispersed whiskers, short fibers, or a mixture thereof, and for permitting the whisker and/or fiber containing dielectric liquid to flow downward, a discharge part for discharging the dielectric liquid downward, and an orientation part through which the dielectric liquid moves downward from the supply part to the discharge part;

said electrodes being installed vertically at a certain distance apart horizontally in the orientation part of the orientation vessel;

said filter sheet drive unit moving a long filter sheet horizontally between the orientation part and the discharge part in the orientation vessel;

said filter sheet permitting the dielectric fluid to pass therethrough and permitting the fibers to aggregate thereon;

said cover part being installed downstream of the filter sheet for feeding a cover sheet onto aggregated fibers on the filter sheet;

wherein, in operation of the apparatus, oriented fiber aggregate is produced by continuously feeding the dielectric liquid with fibers dispersed therein from the supply part to the orientation part, causing the fibers to statically orient with one end thereof pointing to the positive electrode and the other end thereof pointing to the negative electrode by means of a high voltage applied across the positive electrode and the negative electrode in the orientation part, sending the fiber-containing dielectric liquid downward while keeping the oriented state, passing the dielectric liquid alone through the filter sheet and sending the filtered dielectric liquid to the discharge part, aggregating the statically oriented fibers on the filter sheet, moving the filter sheet horizontally by means of the filter sheet drive unit, whereby fiber aggregate in which many fibers are one-dimensionally oriented is continously produced on the filter sheet.

2. An apparatus for producing oriented fiber aggregate as claimed in claim 1, wherein both the positive electrode and the negative electrode are in plate form and two or more positive electrodes and negative electrodes are installed alternately at certain intervals.

3. An apparatus for producing oriented fiber aggregate as claimed in claim 1, wherein a filter plate is installed at the top of the discharge part so that the filter sheet moves on the filter plate while being supported on the filter plate.

4. An apparatus for producing oriented fiber aggregate as claimed in claim 3, wherein said filter sheet drive unit is composed of a filter sheet supply part at the upstream side of the filter sheet at one end of said orientation vessel, and a filter sheet discharge part at the downstream side of the filter sheet at the other end of the orientation vessel whereby the filter sheet is forwarded on and along the filter plate from the filter supply part to the filter discharge part.

5. An apparatus for producing oriented fiber aggregate as claimed in claim 4, wherein said cover part comprises a cover sheet supply means and compression means for covering the surface of the fiber aggregate on the filter sheet with the cover sheet and for compressing the covered fiber aggregate.

6. An apparatus for producing oriented fiber aggregate as claimed in claim 5, wherein a porous belt drive unit is provided to drive a porous belt installed between the filter sheet and the filter plate.

7. An apparatus for producing oriented fiber aggregate as claimed in claim 3, wherein a resistance flow regulator is provided at the supply part of the orientation vessel.

8. An apparatus for producing oriented fiber aggregate as claimed in claim 1 wherein a compression vessel is provided in one end of the case at the downstream side of the filter sheet, and the cover sheet is applied to the aggregate fiber at the entrance of the compression vessel.

* * * * *